US010458088B2

(12) United States Patent
Alan

(10) Patent No.: US 10,458,088 B2
(45) Date of Patent: Oct. 29, 2019

(54) SOIL ADAPTIVE SMART CAISSON

(71) Applicant: Jordan Alan, Los Angeles, CA (US)

(72) Inventor: Jordan Alan, Los Angeles, CA (US)

( * ) Notice: Subject to any disclaimer, the term of this patent is extended or adjusted under 35 U.S.C. 154(b) by 12 days.

(21) Appl. No.: 15/705,212

(22) Filed: Sep. 14, 2017

(65) Prior Publication Data

US 2019/0078283 A1 Mar. 14, 2019

(51) Int. Cl.

| | |
|---|---|
| ***E02D 5/44*** | (2006.01) |
| ***E02D 5/36*** | (2006.01) |
| ***E02D 5/22*** | (2006.01) |
| ***E02D 23/00*** | (2006.01) |

(52) U.S. Cl.

CPC ..... *E02D 5/36* (2013.01); *E02D 5/226* (2013.01); *E02D 5/44* (2013.01); *E02D 23/00* (2013.01)

(58) Field of Classification Search

CPC ..... E02D 5/44; E02D 5/805
USPC ..... 405/237, 238, 240, 244, 248, 249
See application file for complete search history.

(56) References Cited

U.S. PATENT DOCUMENTS

| | | | | |
|---|---|---|---|---|
| 961,492 | A * | 6/1910 | Goldsborough | E02D 5/44 405/237 |
| 2,497,377 | A * | 2/1950 | Swann | E02D 5/32 405/238 |
| 3,742,717 | A * | 7/1973 | Wey | E02D 5/42 405/238 |
| 4,906,141 | A * | 3/1990 | Massarsch | E02D 5/44 405/237 |
| 6,869,255 | B1 * | 3/2005 | Beck, III | E02D 33/00 405/233 |
| 7,004,684 | B2 * | 2/2006 | Fox | E02D 5/44 175/263 |
| 2003/0209363 | A1 * | 11/2003 | Kadaster | E02B 17/00 175/5 |
| 2006/0021447 | A1 * | 2/2006 | Hecht | E02D 5/22 73/803 |
| 2007/0212171 | A1 * | 9/2007 | Rasmussen | E02D 5/46 405/237 |
| 2010/0178115 | A1 * | 7/2010 | McVay | E02D 5/44 405/237 |

* cited by examiner

*Primary Examiner* — Frederick L Lagman
(74) *Attorney, Agent, or Firm* — KSIP

(57) ABSTRACT

A Smart Caisson incorporates an expandable balloon-like body at depth under the base of a vertical piling or foundation member. The self-expanding balloon footing counteracts soil erosion by expanding to fill areas of soil recession. A pipe or through-hole in the vertical piling admits surface rainwater into the balloon footing at the same time the rainwater is contributing to sub-surface erosion. Users can actively pump water downward through the piling through-hole to fill the balloon footing during times of low rainfall or following short-duration erosion events, such as earthquakes. The through-holes are designed to capably admit cement, concrete and other fill materials without clogging or corroding. A metal mesh surrounding the balloon footing expands with the balloon, providing structure and a matrix to trap and hold shifted sub-surface earthen material and concrete previously pumped into the balloon footing. An array of sensors warns the user of sub-surface soil conditions.

12 Claims, 9 Drawing Sheets

SOIL ADAPTIVE SMART CAISSON

FIELD OF THE INVENTION

The invention relates to foundation pilings. More particularly, the present invention relates foundation piling with a self-expanding footing that takes the place of areas of soil recession near the bottom of the piling.

BACKGROUND INFORMATION

Pile or caisson supported foundations have been used commonly for construction on loose or unstable soils, sinking soils, hillsides, cliffsides, seasides and earthquake zones. Loss of soil support at the base of the caisson can occur with soil erosion in most areas, and with soil liquefaction in earthquakes. Pile design practice is based on preventing or mitigating a bending mechanism, wherein lateral loading due to soil loss, movement or spreading induces bending failure in the pile. Less common are considerations necessary to avoid buckling of a pile due to axial load acting on it during a soil liquefaction event.

Gravel and stone can be added to the bottom of a hole dug for a foundation piling to allow rainwater to drain through around the piling base, but this merely underlines the existence of expansive and collapsible soils at the base of many foundation pilings. Where bedrock cannot be reached, the piling relies on upward forces from side friction with the soil and the relatively narrow contact between piling base and soil at the depth of the base, which can be expected to contract and expand.

Preparing the foundation piling hole at depth with soil and gravel can slow or mitigate soil settling and water movement, but cannot truly prevent them. What is sought, then, is a method and apparatus that acknowledges the problems of water and soil movement at the base of a foundation piling or caisson and incorporates structures to take advantage of said water and soil movement in ways that improve stability of the piling at depth. Specifically, such a structure would passively use rain or ground water movement to expand into compressed or vacated soil at depth. It would passively use soil movement to solidify this expanded structure. It would incorporate sensors for monitoring the soil conditions at depth. And, it would allow for active addition of concrete material at depth in instances where soil sensors indicated that passive measures were insufficient.

SUMMARY

A Smart Caisson incorporates an expandable balloon-like body at depth under the base of a vertical piling or foundation member. The self-expanding balloon-like footing matches and counteracts soil erosion by expanding to fill areas of soil recession.

A pipe or through-hole in the vertical piling admits surface rainwater into the balloon footing at the same time the rainwater is contributing to sub-surface erosion. The user can also actively pump water downward through the piling through-hole to fill the balloon footing during times of low rainfall or following short-duration erosion events, such as earthquakes.

The through-holes are designed to capably admit cement, concrete and other fill materials without clogging or corroding. A metal mesh surrounding the balloon footing expands with the balloon, providing structure and a matrix to trap and hold shifted sub-surface earthen material and concrete previously pumped into the balloon footing.

An array of sensors running from the bottom to the top of the Smart Caisson warn the user of sub-surface soil conditions and the condition of the balloon footing, metal mesh and piling.

DETAILED DESCRIPTION

Figure 1:
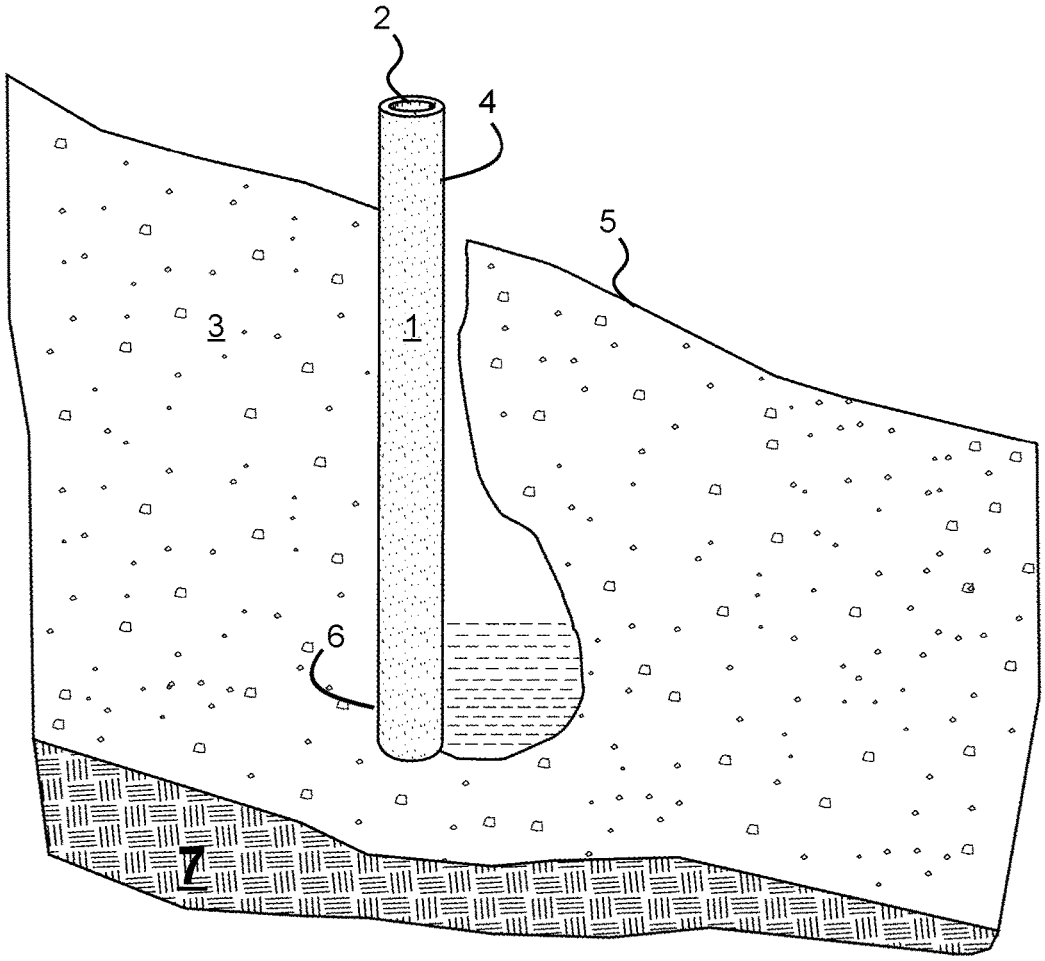
FIG. 1 (PRIOR ART)
FIG. 1 (PRIOR ART) is a side view of a typical foundation support piling.

FIG. 1 (PRIOR ART) is a side view of a typical foundation support piling in the prior art 1. The prior art support piling can be solid or hollow, with the open top illustrated 2 showing a hollow piling. A hollow piling is also referred to as a caisson, but the terms piling and caisson will be used interchangeably in this disclosure to refer to both solid and hollow foundation pilings.

The pictured prior-art piling is driven into sloped soil 3, such as occurs when a house is supported on a hillside. The upper end 4 of the piling extends above the soil surface 5 and the lower end 6 of the prior art piling as pictured is not deep enough to reach bedrock 7.

Soil shifting, water erosion and earthquake liquefactions cause recession 8 of the soil from the piling, illustrated by stylized soil separation from the downhill side of the vertical surface of the prior art piling. Soil recession results in increased potential for pile settlement, horizontal displacements and bending moment under lateral load. Water buildup 9 in the recessed area shown near the base of the piling creates further problems with erosion and settling.

Figure 2:
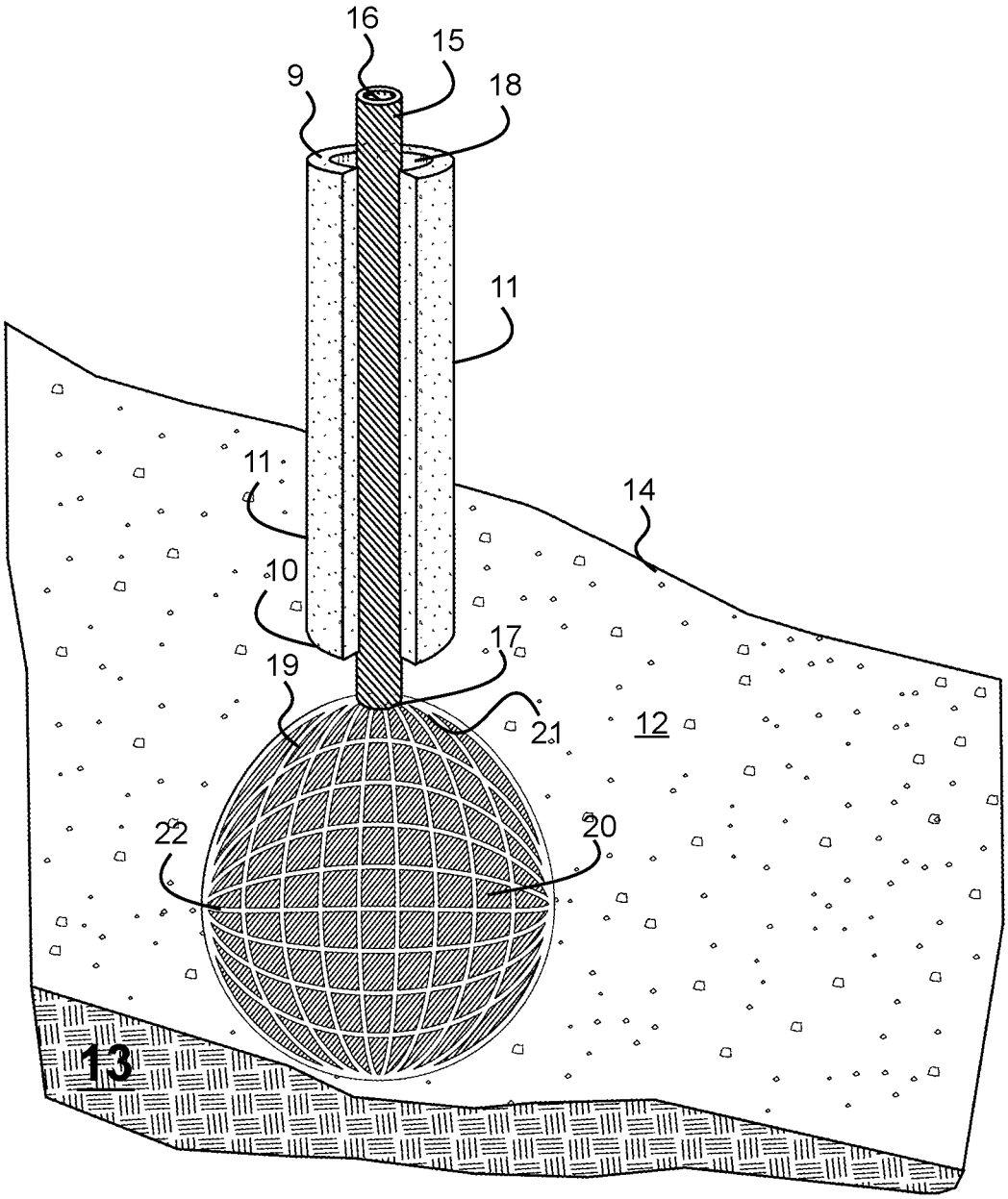
FIG. 2 illustrates a Smart Caisson foundation support piling with expanding base.

FIG. 2 illustrates a Smart Caisson foundation support piling with self-expanding footing means that matches and counteracts soil erosion. The stylized illustration shows a vertical foundation member 8 being a piling or caisson with an upper end 9, a lower end 10 and a vertical surface or side 11 of a cylinder in the preferred embodiment. In an alternate embodiment, the vertical foundation member that is an elongated quadrilateral, pentagon, hexagon, octagon or similar shape rather than a round cylinder can have a series of four, five, six, eight or similar number of vertical slab surfaces rather than a continuous circular vertical surface in lateral contact with soil. As noted, above, in regard to FIG. 1, vertical foundation member will typically be a solid concrete piling, but can be a hollow or partially-hollow caisson where appropriate and use other materials where appropriate.

The vertical foundation member is typically situated such that it extends into earthen material 12 such that friction between the vertical surface 11 and earthen material 12 results in some upward force on the vertical foundation member. The vertical foundation member lower end 10 often ends at or above bedrock 13. The vertical foundation member upper end 9 is typically extended above the soil surface 14 to at least some distance.

A stylized foundation member through-hole 15 is illustrated having an upper opening 16 and a lower opening 17. The foundation member through-hole extends from the upper end of the vertical foundation member, down through the vertical foundation member and to the lower end of the vertical foundation member. The foundation member through-hole can simply be a hole 18 formed in the vertical foundation member, but in the preferred embodiment is an open downpipe through such a hole formed in the vertical foundation member.

The pipe of the foundation member through-hole in the preferred embodiment is formed of a metal or durable plastic suitable for use with a concrete foundation piling. The pipe of the foundation member through-hole in the preferred embodiment is also able to withstand repeated exposure to rainwater or pumped water.

Suitable metals for through-hole downpipes include steel, galvanized steel, iron, galvanized iron, copper, brass and bronze. Aluminum or other metals subject alkali reactions with concrete would not be suitable. Suitable plastics include some PVCs not subject to alkali reactions or PEX materials having enough hardness for plumbing pipes of thirty feet or more.

Adjacent the vertical foundation member lower end 10 and foundation member through-hole lower opening 17 is illustrated a puncture-resistant foundation footing balloon member 19 having a first balloon exterior surface 20, a first balloon interior and a first balloon upper surface 21 adjacent the vertical foundation member lower end 10.

The foundation footing balloon member will typically be globular, lozenge shaped or other rounded shape extending wider than the diameter of the vertical foundation member in at least one dimension. The foundation footing balloon member is of a flexible, inflatable material that holds water and resists puncture by stones, shards, sticks, rubble and other buried materials. Examples of puncture-resistant balloon structures will include flexible fuel bladders and fuel cells such as found in U.S. Pat. No. 3,622,035 "PUNCTURE-RESISTANT FUEL CONTAINER" or U.S. Pat. No. 4,574,986 "FLEXIBLE CONTAINER SYSTEM".

The foundation footing balloon member will have, for each foundation member through-hole, a neck opening in its upper surface 21 operatively mated to its foundation member through-hole lower opening 17 so as to provide an open path via the foundation member through-hole and through the neck opening into the balloon interior. The neck-hole mating will, in the preferred embodiment, have the foundation member through-hole lower opening extending inside the balloon member neck opening, screwed together or otherwise fixatively attached such that water, cement or concrete aggregate can fit through the through-hole and balloon neck opening connection without obstruction.

Some embodiments of the invention will also include, as depicted, an expansible foundation mesh body 22, capable of expanding to at least the maximum volume of the foundation footing balloon member. The expansible foundation mesh body functions as a net of tough material surrounding the balloon member. The expansible foundation mesh body material may be of durable plastic or corrosion-resistant metals as seen in braided steel automotive hoses. In most embodiments, the expansible foundation mesh body will be strongly affixed to the lower end of the vertical foundation member, using, for example, eyebolts, bent rebar or welded rebar.

The balloon member is depicted in an expanded stated, having expanded to fill in areas of displaced or eroded earthen material below the vertical foundation member. The balloon member is depicted as globular in shape, but other balloon or bladder shapes may be used according to availability. When first installed, the balloon member will typically be mostly or entirely deflated, in anticipation of later displacement of adjacent soil.

Figure 3:
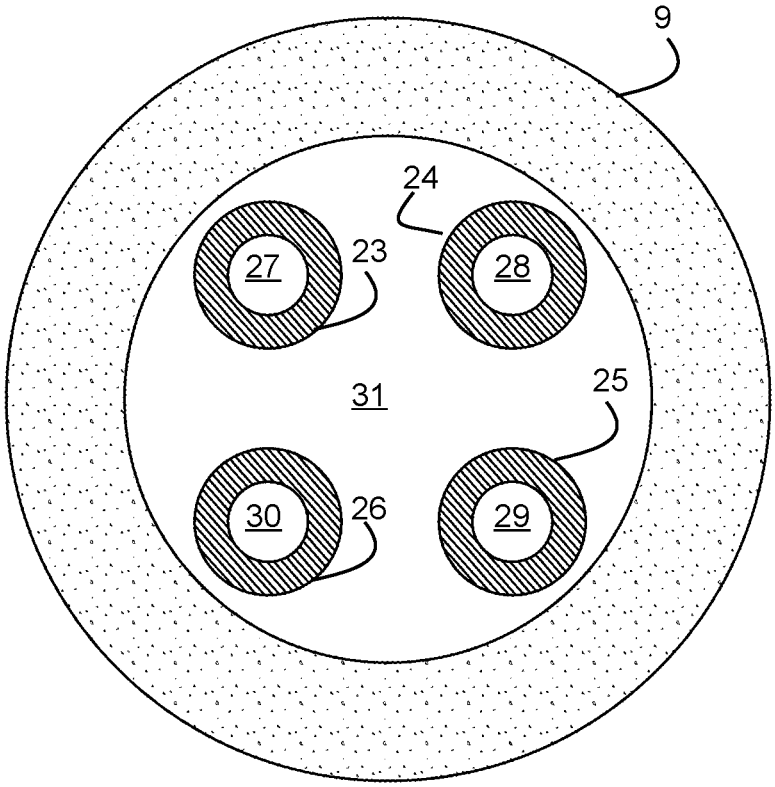
FIG. 3 is a top view of a Smart Caisson with four inlet holes.

FIG. 3 is a top view of a Smart Caisson with four inlet holes. Depicted are the top of the vertical foundation member upper end 9, a first 23, second 24, third 25 and fourth 26 foundation member through-hole, a first 27, second 28, third 29 and fourth 30 foundation member through-hole downpipe, and a foundation member cap 31. In the preferred embodiment, the foundation piling with self-expanding footing of the invention features a single through-hole and downpipe. However, more than one through-hole may be used for foundation pilings with large diameters or where high volumes of rainwater in short, high intensity rainstorms are anticipated. Multiple through-holes will typically be arranged symmetrically.

Each foundation member through-hole upper opening extends vertically through the foundation member cap in order to be capable of admitting rainwater passively. The foundation member cap may be made concave in order to channel rainwater to the through-hole. The passive environmental rainwater thus helps fill the foundation footing balloon member to press outward against adjacent areas of soil recession, sometimes also caused by concurrent environmental rainwater.

Figure 4:
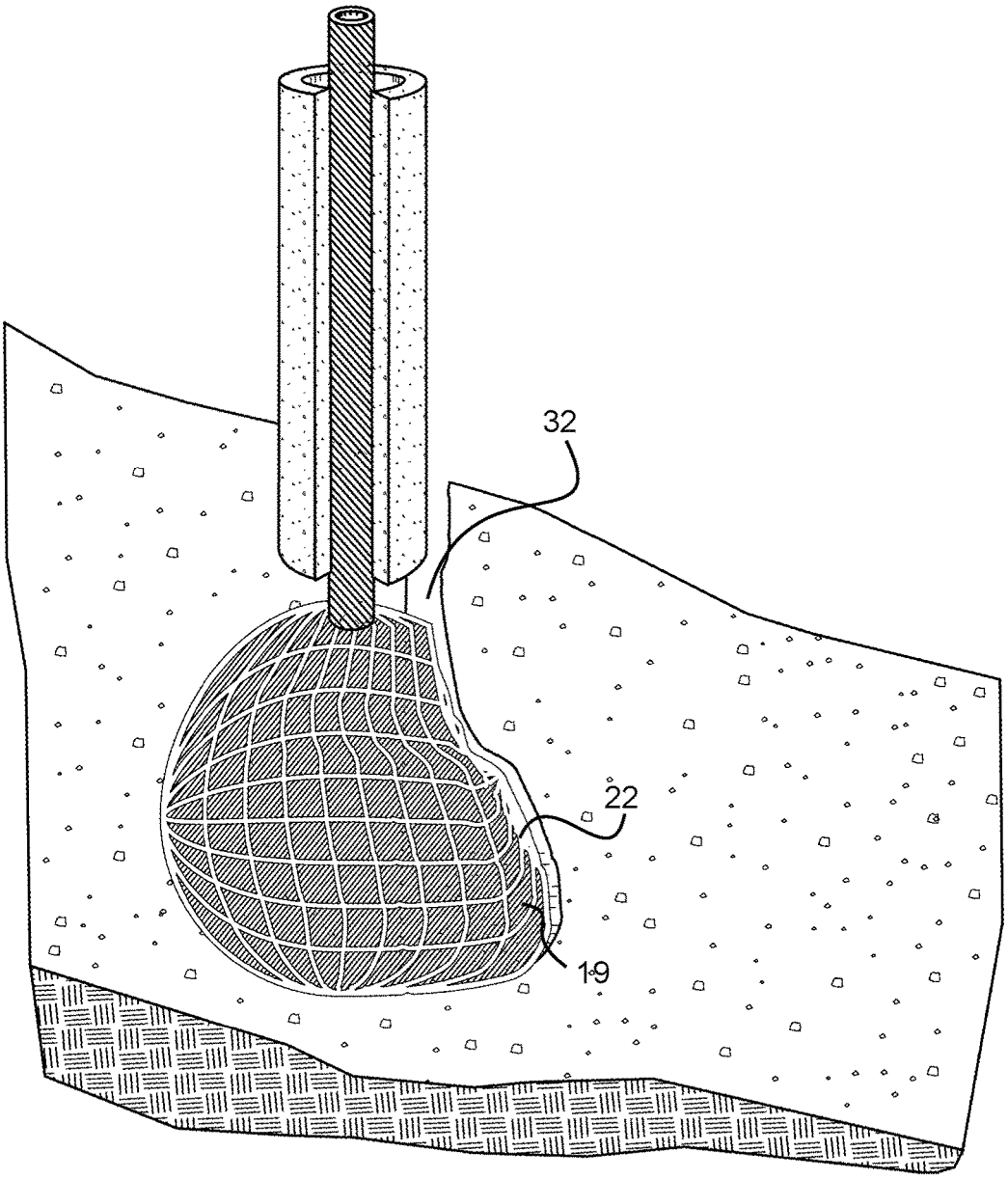
FIG. 4 illustrates a Smart Caisson foundation support piling with base expanded to fill an irregular space.

FIG. 4 illustrates a Smart Caisson foundation support piling with base expanded to fill an irregular space 32. The irregular space has resulted adjacent the footing of the foundation piling due to soil erosion, movement, spreading or liquefaction. The foundation footing balloon member, along with its surrounding mesh, expands to fill the shape of the irregular space.

In the first embodiment of the invention, the expansion of the foundation footing balloon member occurs passively due to admission of rainwater via through-holes. However, expansion of the foundation footing balloon member can be performed actively, by pumping or pouring water into the upper opening of a through-hole. Active pumping of water into the foundation footing balloon member may be needed where, for instance, soil liquefaction occurs in absence of significant passive rainwater.

Further, in additional embodiments of the invention, the expanded shape of the foundation footing balloon member can be solidified using cement, aggregate or concrete. The through-holes can be used to pour dry cement powder or concrete mix into the foundation footing balloon member, followed by pressurized water to prevent cement adhering to the inside of the through-holes. Once the cement mixture has cured, the foundation footing will be improved even over initial installation, even if the balloon member is later torn.

For the foundation member through-holes to reliably transmit cement and aggregate, the diameter of the through-holes should be at least three times the diameter of the largest aggregate materials intended to be used.

Where practical, pumping of wet concrete directly into the foundation footing balloon member via the through-holes can be performed. In practice, this means that through-holes can have a diameter of as little as three inches for use with peristaltic concrete pumps, or up to eight inches for use with direct action, piston type concrete pumps.

Figure 5:
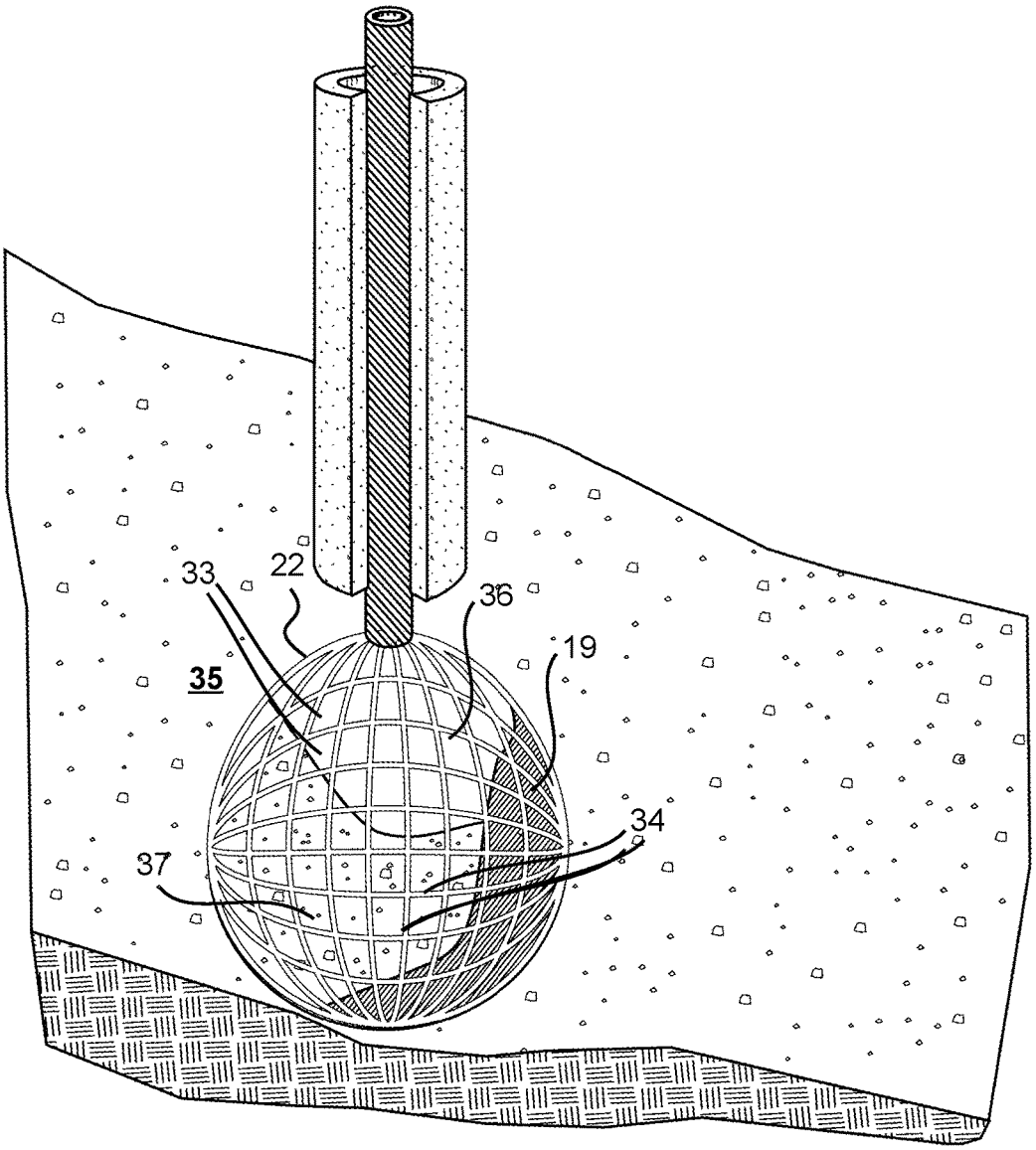
FIG. 5 illustrates a Smart Caisson foundation support piling with the expanded base having been burst or deflated.

FIG. 5 illustrates a Smart Caisson foundation support piling with the expanded balloon member base 19 having been burst, punctured or deflated. The balloon exterior surface having been encased in the expansible foundation mesh body prior to being punctured, consequently the expansible foundation mesh body 22 is depicted in the fully expanded state it would have achieved prior to the puncturing of the balloon member.

The expansible foundation mesh body having lattice-like openings 33 between the mesh elements 34, adjacent earthen material 35 is admitted to the interior 36 of the expansible foundation mesh body through the lattice-like openings as the exterior surface of the balloon member deflates and recedes. The adjacent earthen material sifts into the expansible foundation mesh primarily body from above and from the uphill side, but can also sift in during soil shifting events. The admitted earthen material 37 is trapped inside the expansible foundation mesh body by the combination of exterior earthen material, mesh body and deflated balloon body, anchoring the mesh where otherwise would have been shifting soil. The mesh elements are depicted as latitudinal and longitudinal, but can be diagonal.

As with the through-holes, a larger mesh opening allows for sifting in of larger aggregate material in the adjacent soil. For use in clumping clay soils or where large stone aggregate is mixed in with the soil, a loose mesh with openings of two inches in diameter or greater can be used. For dry soils, sandy soils or smaller particulates, a tighter mesh with openings of one inch in diameter or lower can be used. A looser mesh can be used on the top side of the mesh body and a tighter mesh on the bottom half, to help retain admitted earthen material.

Figure 6:
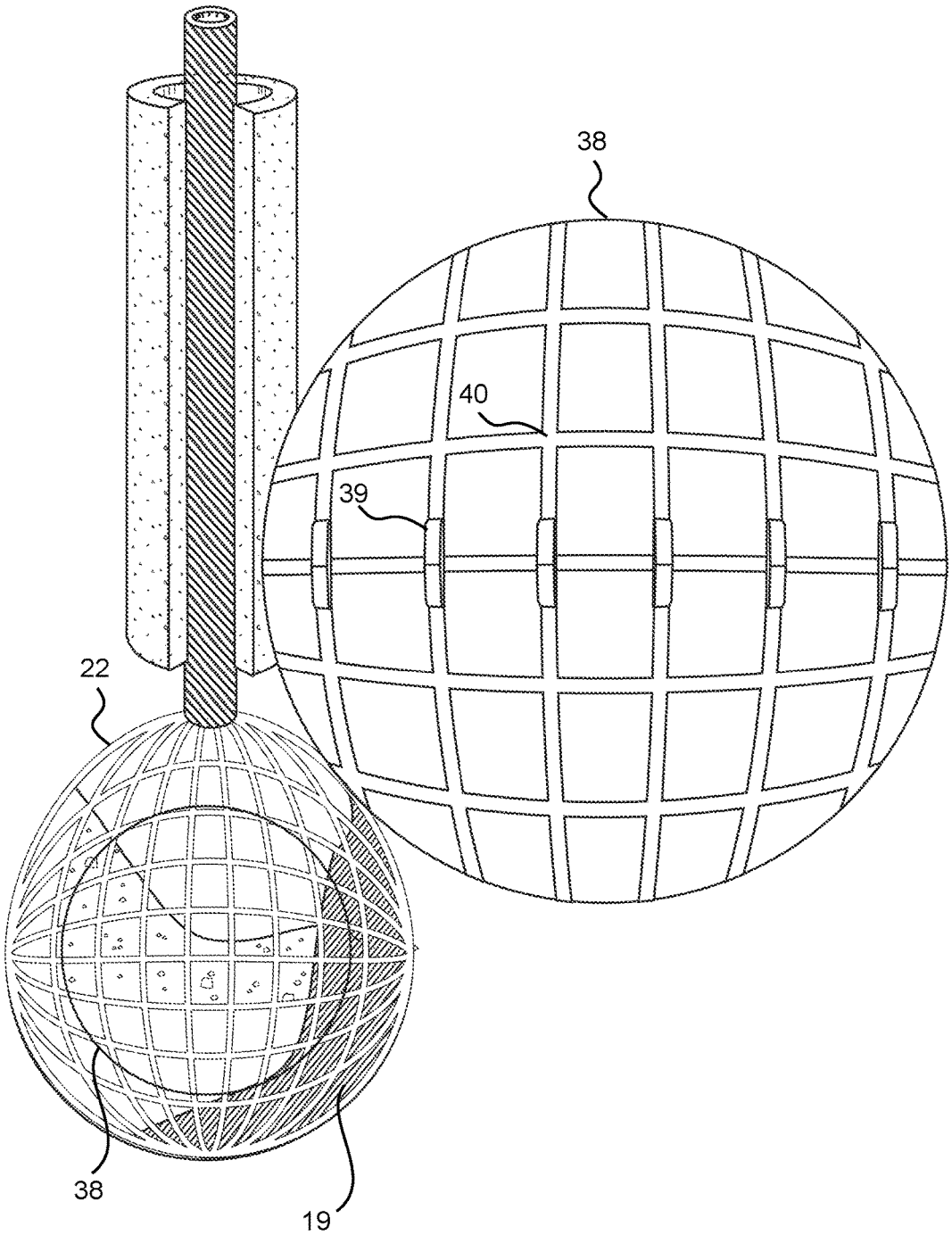
FIG. 6 shows, in an expanded view of an expansible foundation mesh body, locking support mechanisms arrayed about the equator of an expansible foundation mesh body.

FIG. 6 shows, in an expanded view 38 of the expansible foundation mesh body 22, locking support mechanisms 39 arrayed about the equator of an expansible foundation mesh body. To support the expansible foundation mesh body during the deflation of the balloon member, and to give more opportunity for earthen material to be admitted into the interior of the expansible foundation mesh body, sliding locking structures 39 are used with the expansible foundation mesh body 22 in some embodiments of the invention. The sliding locking structures 39 can be attached to the expansible foundation mesh body at intersections 40, or integrated into the longitudinal lines and/or latitudinal lines of the expansible foundation mesh body.

As the expansible foundation mesh body is expanded by the balloon member, sliding locking structures 39 lock open so as to resist reversion of the expansible foundation mesh body 22 to its unexpanded state. During shifting or deflation of the balloon member 19, the sliding locking structure of the expansible foundation mesh body holds the expansible foundation mesh body apart from the balloon member exterior surface, allowing admitted earthen material to fill the space between the expansible foundation mesh body and the balloon member.

In the illustration, sliding locking structures are arrayed in a single equatorial line around the expansible foundation mesh body. The indicated sliding locking structures slide and lock vertically, resisting vertical flattening of the expansible foundation mesh body. In other embodiments of the invention, additional latitude lines above and below the equatorial line will have sliding locking structures, further resisting vertical flattening.

Figure 7A:
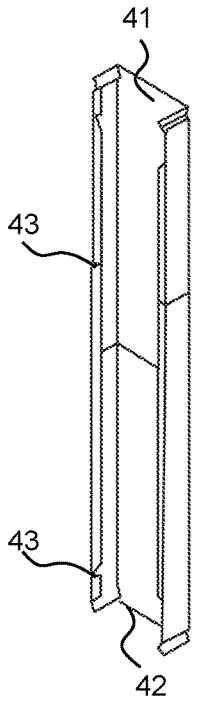
FIGS. 7A, 7B and 7C show sliding locking structures as used with the expansible foundation mesh body.
Figure 7B:
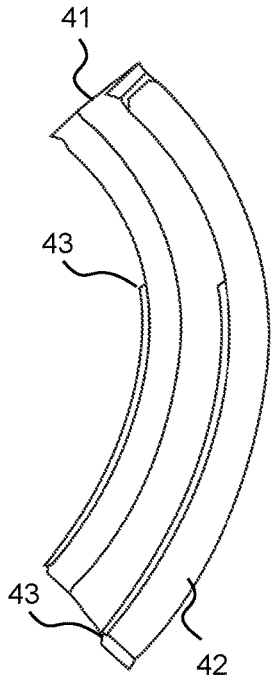
Figure 7C:
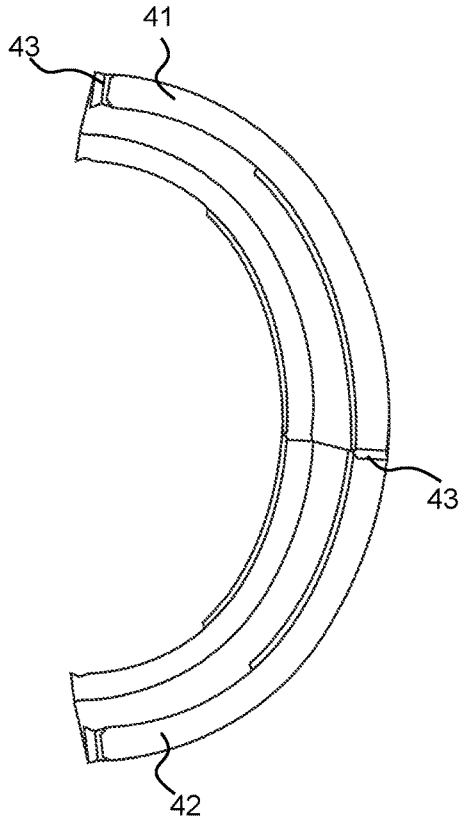

FIGS. 7A, 7B and 7C show sliding locking structures of the expansible foundation mesh body.

FIG. 7A shows a flat, uncurved telescoping sliding locking structure for illustrative purposes; sliding locking structures in use with the expansible foundation mesh body will have some degree of curve in most embodiments. The flat sliding locking mechanism is partially extended open. An upper section 41 and a lower section 42, only partially locked open, still overlap. Locking tabs 43 at either end of each section retract if slid further open, but lock to prevent sliding to close, in reverse. Telescoping sliding locking structures are known in the art; an exemplary telescoping sliding locking structure is seen in the TRAKLOC proprietary drywall framing system.

FIG. 7B shows a curved sliding locking structure. The curved sliding locking mechanism is partially extended open. Locking tabs 43 at either end of each section 41 42 retract if slid further open, but lock to prevent sliding to close, in reverse.

FIG. 7C shows a curved sliding locking structure when locked fully extended. Tabs 43 on the section ends lock into tabs, preventing the two sliding sections 41 42 from moving out of the extended position.

Figure 8:
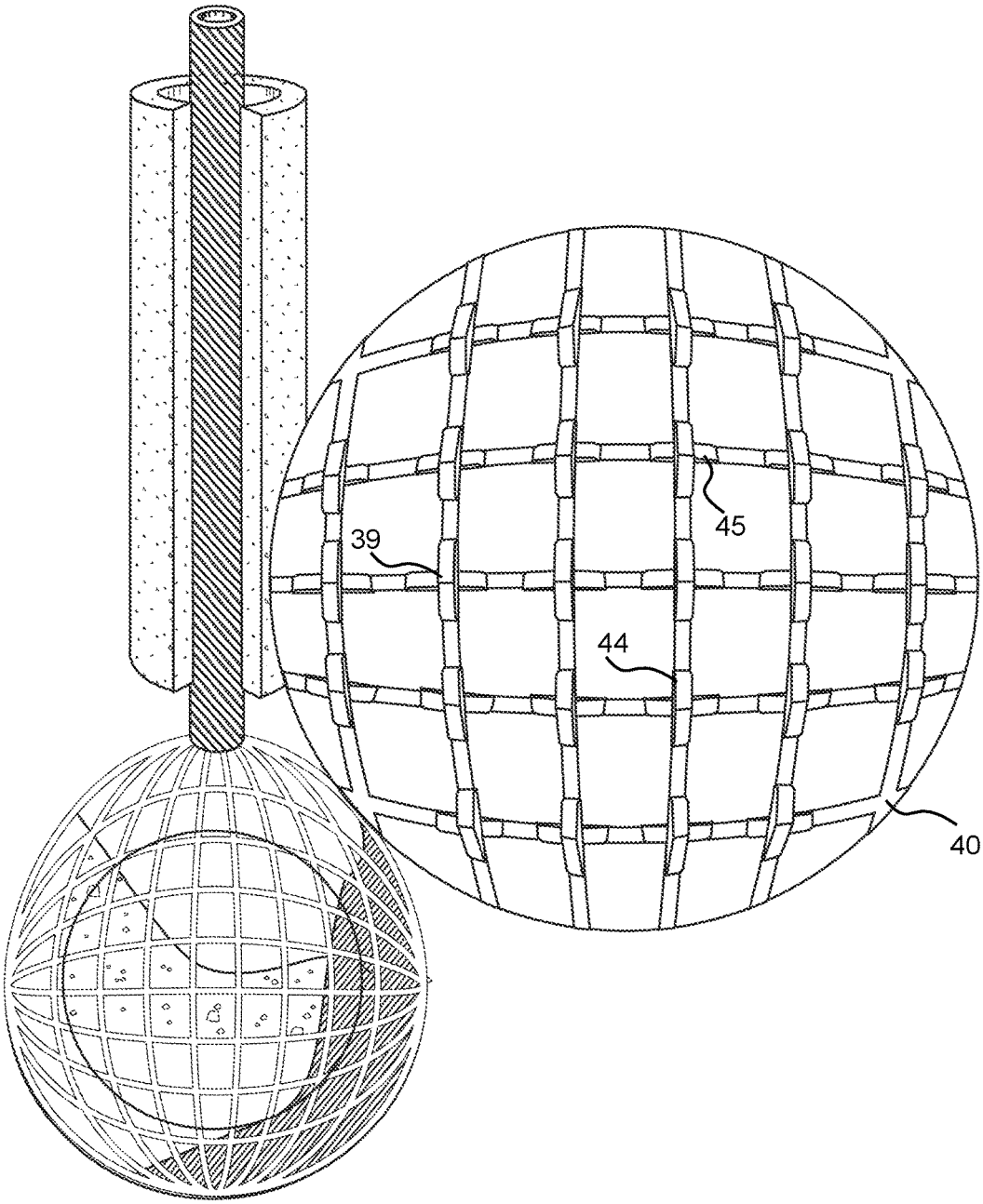
FIG. 8 illustrates the expansible foundation mesh body with sliding locking structures at each intersection.

FIG. 8 illustrates the expansible foundation mesh body 22 with sliding locking structures 39 at each intersection 40. In the illustration, sliding locking structures are arrayed in latitudinal and longitudinal lines around the expansible foundation mesh body. The vertical sliding locking structures 44 slide and lock vertically, resisting vertical flattening of the expansible foundation mesh body. The horizontal sliding locking structures 45 slide and lock horizontally, resisting horizontal crushing of the expansible foundation mesh body.

Figure 9:
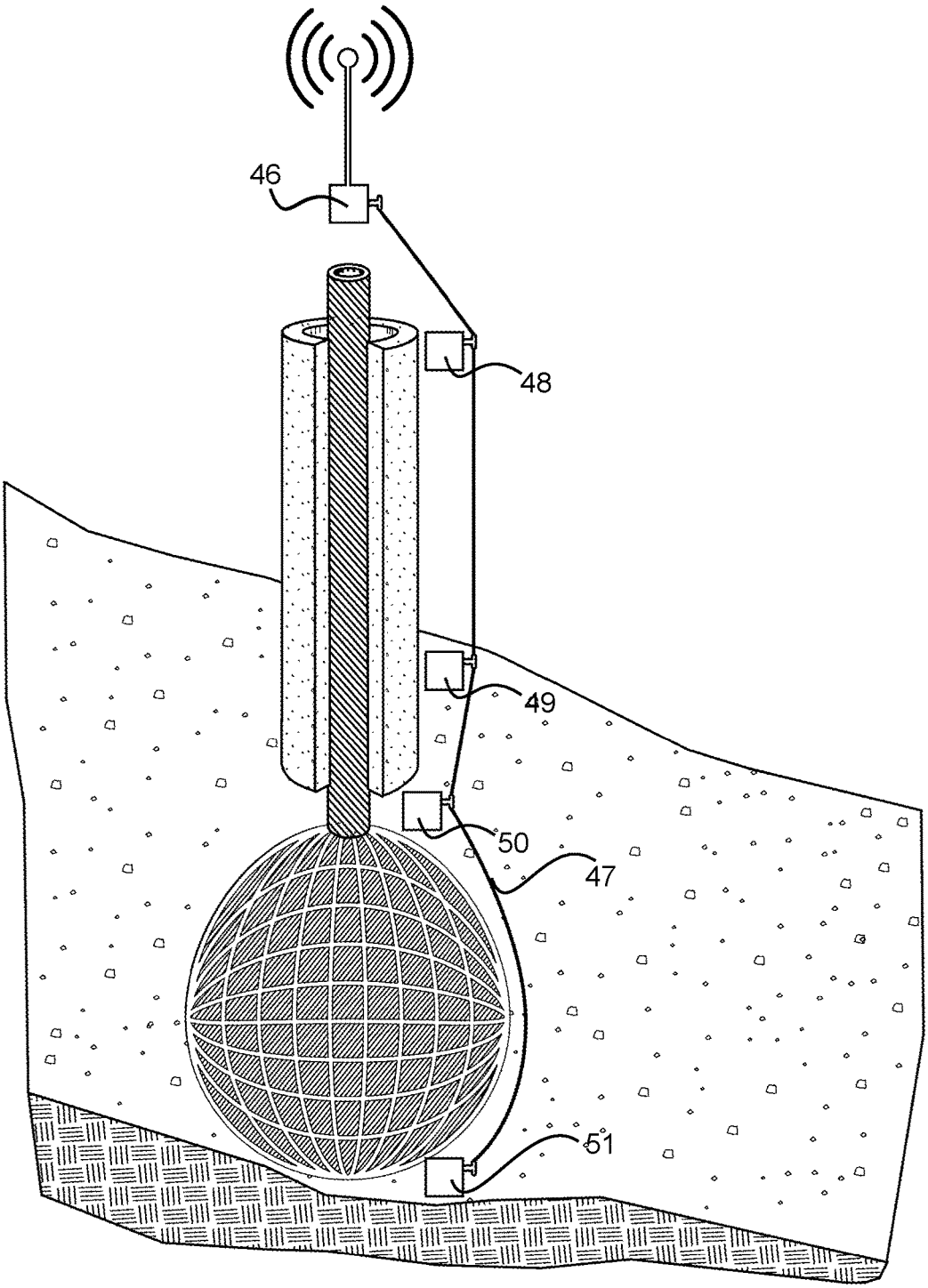
FIG. 9 illustrates a Smart Caisson foundation support piling with monitoring sensor system.

FIG. 9 illustrates a Smart Caisson foundation support piling with monitoring sensor system. Above ground, a condition sensor receiver unit 46 is connected by signal transmission cables 47 to embedded foundation piling condition sensors. One embedded condition sensor 48 is depicted on the above-ground vertical surface of the foundation piling. Another embedded condition sensor is depicted 49 on the below-ground vertical surface of the foundation piling. A third embedded condition sensor is depicted 50 measuring conditions at the lower end of the foundation piling and the upper surface of the foundation footing balloon member. A fourth embedded condition sensor is depicted measuring conditions at the bottom surface 51 of the foundation footing balloon member. Other locations for embedded condition sensors can be used, but these are exemplary.

Depending on location, embedded condition sensors can be used to measure movement, bending or stresses on the vertical foundation member; movement, recession or liquefaction of earthen material adjacent the vertical foundation member or footing; soil moisture; the volume, interior pressure or exterior pressure of the footing balloon member; contents analysis of the foundation footing balloon member—for example, by temperature or pH; and, distance between two sensors, so as to measure the expansion or collapse of the foundation footing balloon member or its mesh.

The condition sensor receiver unit can be accessed wirelessly by smart-phone, or by a local terminal, in order to read embedded condition sensor data. The embedded condition sensor data can help to determine the history and stability of the foundation piling, and whether it is warranted to add water, cement or pumped concrete via the through-holes. Portions of the connections between sensors and receiver can be made wireless, particularly where above ground.

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A foundation piling with self-expanding footing that counteracts soil erosion, comprising:

a vertical foundation member partially or fully embedded in earth, having an upper end, a lower end and a vertical surface, and capable of supporting a portion of building structure;

a first foundation member through-hole having a first through-hole upper opening and a first through-hole lower opening, said first foundation member through-hole extending vertically through the vertical foundation member upper end, through the vertical foundation member, and through the vertical foundation member lower end;

a first puncture-resistant foundation footing balloon member having a first balloon exterior surface, a first balloon interior and a first balloon upper surface adjacent the vertical foundation member lower end, said first balloon exterior surface being encased in an expansible foundation mesh body having a foundation mesh body volume, said first balloon exterior surface being adjacent earthen material capable of recession, said first puncture-resistant foundation footing balloon member having a foundation footing balloon member maximum volume, said foundation footing balloon member having a first neck opening in said balloon upper surface, said first neck opening being operatively mated to said first foundation member through-hole lower opening so as to provide an open path via said first foundation member through-hole and via said first neck opening into said first balloon interior, said first puncture-resistant foundation footing balloon member being partially or fully deflated after installation of the vertical foundation in earth is completed.

2. The foundation piling with self-expanding footing of claim 1, said expansible foundation mesh body being capable of expanding to at least the foundation footing balloon member maximum volume.

3. The foundation piling with self-expanding footing of claim 1, said expansible foundation mesh body having latticework openings, said latticework openings being capable of admitting a first volume of adjacent earthen material.

4. The foundation piling with self-expanding footing of claim 1, said expansible foundation mesh body being capable of admitting a first volume of adjacent earthen material, said first puncture-resistant foundation footing balloon member having a foundation footing balloon in-situ expanded volume greater than zero and less than or equal to the foundation footing balloon member maximum volume, said expansible foundation mesh body having a foundation mesh body interior and having an in-situ expanded volume greater than or equal to said foundation footing balloon in-situ expanded volume, said first puncture-resistant foundation footing balloon member capable of being collapsed, said first volume of admitted adjacent earthen material substantially displacing the collapsed first puncture-resistant foundation footing balloon member, said first volume of admitted adjacent earthen material being greater than zero and less than or equal to the foundation footing balloon member maximum volume, partially or fully filling the foundation mesh body interior.

5. The foundation piling with self-expanding footing of claim 1, said expansible mesh body having a foundation mesh body interior, having a current volume, and capable of being expanded to a greatest in-situ expanded volume greater than zero, said expansible foundation mesh body having locking mechanisms capable of resisting compression such that the expansible foundation mesh body resists having its current volume being reduced below its greatest in-situ expanded volume.

6. A method of installing a foundation piling comprising the steps of:

forming at least a portion of a vertical foundation member, said vertical foundation member having a first foundation member through-hole with a first through-hole upper opening and a first through-hole lower opening, said first foundation member through-hole extending vertically through the vertical foundation member;

operatively connecting a first puncture-resistant foundation footing balloon member having a first neck opening and a first balloon interior to the first through-hole lower opening so as to provide an open path via said first foundation member through-hole and via said first neck opening into said first balloon interior;

said vertical foundation member with said first puncture-resistant foundation footing balloon member being formed within or else lowered into a foundation piling hole such that the vertical foundation member is above the first puncture-resistant foundation footing balloon member;

leaving the puncture-resistant foundation footing balloon member partially or fully deflated upon completion of foundation piling installation; and, leaving said first foundation member through-hole upper opening disposed so as to admit environmental rainwater after foundation piling installation, said rainwater being thereby transmitted downward via said first neck opening into said first balloon interior, said rainwater thereby exerting fluid pressure on said first balloon interior, said first puncture-resistant foundation footing balloon member thereby expanding so as to fill any adjacent areas of recessed earthen material.

7. The method of claim 6, further comprising the step of:

pumping in dry cement material or dry concrete mix material through said first foundation member through-hole upper opening, said dry concrete mix material comprising aggregate materials and said aggregate materials having diameter, said first foundation member through-hole being at least three times the diameter of said aggregate materials, said pumped-in material being thereby transmitted downward via said first neck opening into said first balloon interior.

8. The method of claim 6, further comprising the step of:

pumping in wet cement mixture or wet concrete mix material via said first foundation member through-hole upper opening, said wet concrete mix material comprising aggregate materials and said aggregate materials having diameter, said first foundation member through-hole being at least three times the diameter of said aggregate materials, said pumped-in material being thereby transmitted downward via said first neck opening into said first balloon interior.

9. The method of claim 6, further comprising the step of:

placing a first condition sensor receiver unit adjacent an above-ground portion of the foundation piling; and, installing at least one embedded condition sensor, said embedded condition sensor being disposed on the exterior of the balloon member self-expanding footing or the interior of the balloon member self-expanding footing, said embedded condition sensor being operatively connected to said first condition sensor receiver unit such that said embedded condition sensor transmits a first set of data to said first condition sensor receiver unit, said first set of data comprising at least one of:

movement of earthen material said puncture-resistant foundation footing balloon;

soil moisture proximal said puncture-resistant foundation footing balloon;

puncture-resistant foundation footing balloon member volume;

puncture-resistant foundation footing balloon member interior pressure;

puncture-resistant foundation footing balloon member exterior pressure; and, puncture-resistant foundation footing balloon member contents analysis.

10. The method of claim 6, further comprising the steps of:

enclosing said first balloon exterior surface in an expansible foundation mesh body having a foundation mesh body volume, said expansible foundation mesh body capable of expanding to at least the foundation footing balloon member maximum volume;

placing a first condition sensor receiver unit adjacent an above-ground portion of the foundation piling; and, installing at least one embedded condition sensor, said embedded condition sensor being disposed on the exterior of the balloon member self-expanding footing or on the expansible foundation mesh body, said embedded condition sensor being operatively connected to said first condition sensor receiver unit such that said embedded condition sensor transmits a first set of data to said first condition sensor receiver unit, said first set of data comprising at least one of:

movement of earthen material said puncture-resistant foundation footing balloon;

soil moisture proximal said puncture-resistant foundation footing balloon;

puncture-resistant foundation footing balloon member volume;

puncture-resistant foundation footing balloon member exterior pressure; and, foundation mesh body volume.

11. A foundation piling with self-expanding footing that counteracts soil erosion, comprising:

a vertical foundation member partially or fully embedded in earth, having an upper end, a lower end and a vertical surface, and capable of supporting a portion of building structure;

a first foundation member through-hole having a first through-hole upper opening and a first through-hole lower opening, said first foundation member through-hole extending vertically through the vertical foundation member upper end, through the vertical foundation member, and through the vertical foundation member lower end;

a first puncture-resistant foundation footing balloon member having a first balloon exterior surface, a first balloon interior and a first balloon upper surface adjacent the vertical foundation member lower end, said first balloon exterior surface being adjacent earthen material capable of recession, said first puncture-resistant foundation footing balloon member having a foundation footing balloon member maximum volume, said foundation footing balloon member having a first neck opening in said balloon upper surface, said first neck opening being operatively mated to said first foundation member through-hole lower opening so as to provide an open path via said first foundation member through-hole and via said first neck opening into said first balloon interior, said first puncture-resistant foundation footing balloon member initially being partially or fully deflated; and, a first condition sensor receiver unit adjacent an above-ground portion of the foundation piling; and, at least one embedded condition sensor, said embedded condition sensor being disposed on a vertical surface or bottom of the foundation piling, said embedded condition sensor being operatively connected to said first condition sensor receiver unit such that said embedded condition sensor transmits a first set of data to said first condition sensor receiver unit, said first set of data comprising at least one of:

vertical foundation member movement;

movement of earthen material proximal the foundation piling with self-expanding footing;

movement of earthen material proximal the foundation piling with self-expanding footing; and, soil moisture proximal the foundation piling with self-expanding footing;

said embedded condition sensor being disposed on the exterior of the balloon member self-expanding footing or the interior of the balloon member self-expanding footing, said first set of data comprising at least one of:

movement of earthen material said puncture-resistant foundation footing balloon;

soil moisture proximal said puncture-resistant foundation footing balloon;

puncture-resistant foundation footing balloon member volume;

puncture-resistant foundation footing balloon member interior pressure;

puncture-resistant foundation footing balloon member exterior pressure; and, puncture-resistant foundation footing balloon member contents analysis.

12. The foundation piling with self-expanding footing of claim 11, said first balloon exterior surface being enclosed in an expansible foundation mesh body having a foundation mesh body volume, said expansible foundation mesh body capable of expanding to at least the foundation footing balloon member maximum volume;

wherein said embedded condition sensor is disposed on the exterior of the balloon member self-expanding footing or on the expansible foundation mesh body, said embedded condition sensor being operatively connected to said first condition sensor receiver unit such that said embedded condition sensor transmits a first set of data to said first condition sensor receiver unit, said first set of data comprising at least one of:

movement of earthen material said puncture-resistant foundation footing balloon;

soil moisture proximal said puncture-resistant foundation footing balloon;

puncture-resistant foundation footing balloon member volume;

puncture-resistant foundation footing balloon member exterior pressure; and, foundation mesh body volume.

* * * * *